United States Patent [19]

Baus

[11] 4,008,652

[45] Feb. 22, 1977

[54] VENTILATING DEVICE

[76] Inventor: Heinz Georg Baus, Ulmenweg 46, Thun, Switzerland, CH-3601

[22] Filed: Mar. 6, 1975

[21] Appl. No.: 555,951

[30] Foreign Application Priority Data

Mar. 8, 1974 Germany ..... 2411053

[52] U.S. Cl. ..... 98/39; 98/114; 415/54; 415/147

[51] Int. Cl.[2] ..... F24F 13/10

[58] Field of Search ..... 98/37, 39, 40 C, 94, 98/114; 415/54, 147

[56] References Cited

UNITED STATES PATENTS

| | | | |
|---|---|---|---|
| 2,086,112 | 7/1937 | Atkins | 98/39 |
| 2,825,500 | 3/1958 | McLean | 98/39 X |
| 3,331,304 | 7/1967 | Baus | 98/114 X |
| 3,494,415 | 2/1970 | McNabney | 415/54 X |

*Primary Examiner*—William E. Wayner
*Assistant Examiner*—William E. Tapolcai, Jr.
*Attorney, Agent, or Firm*—Herbert L. Lerner

[57] ABSTRACT

Ventilating device including an outer casing formed of a casing part having a forward side formed with an opening, and a lid articulatingly connected to a lower forward edge of the casing part, partly defining the opening, the outer casing being installable in a window frame, the outer casing being elongated and having a substantially uniform cross section over the entire length thereof, the casing part in a rearward lower region thereof being formed with openings, the outer casing in closed condition of the lid and the casing part having an octagonal outer cross section with upper and lower horizontal surfaces engageable by correspondingly wide surfaces of a window frame, with a forward vertical surface entirely and both forward inclined surfaces at least partly formed by the lid, and with a lower rearward inclined surface wherein the openings are formed.

21 Claims, 17 Drawing Figures

Fig. 8
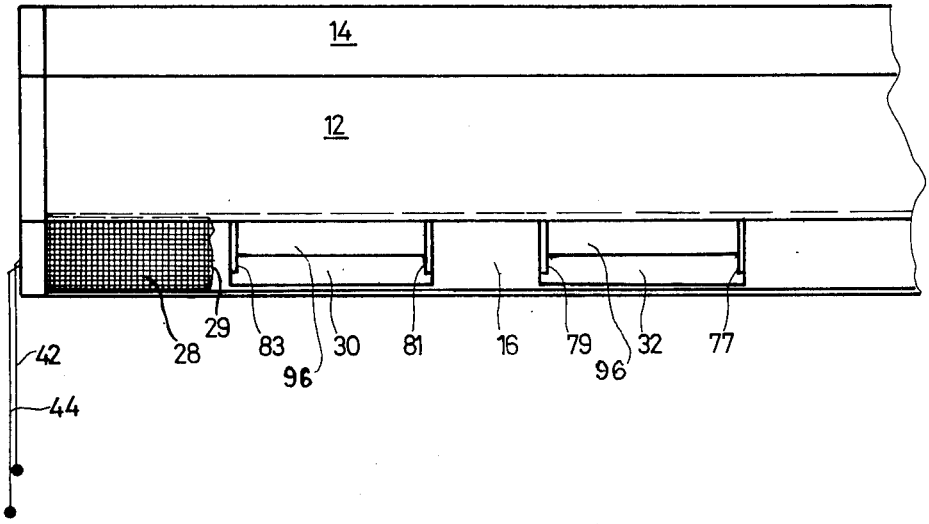
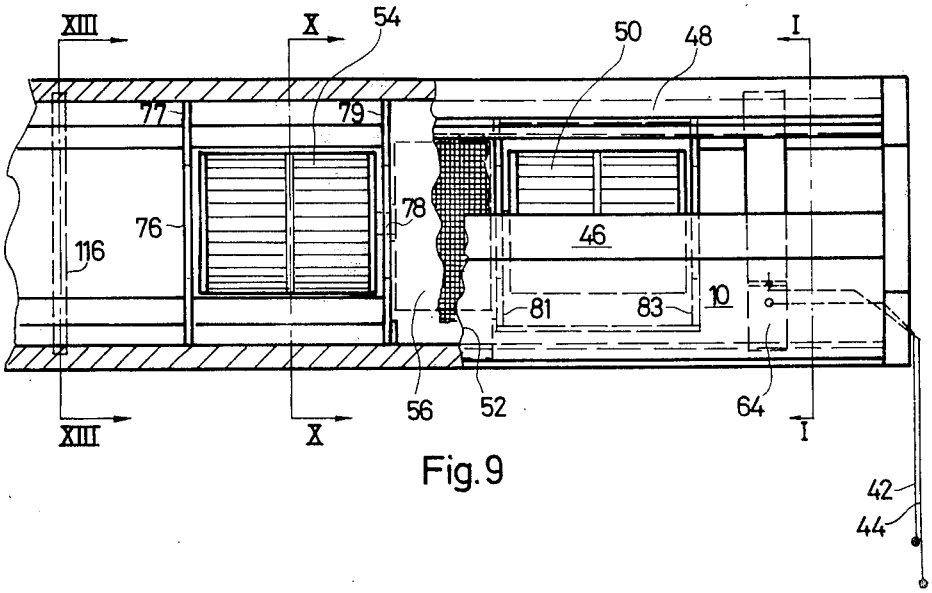
Fig. 9

VENTILATING DEVICE

The invention relates to a ventilating device and, more particularly, to such a device having an outer casing formed of a casing part as well as a lid articulatingly connected to a lower forward edge of the casing part, the outer casing being installable in a window frame, both parts of the outer casing, namely the casing part and the lid, having a substantially uniform cross section over the entire length thereof, the casing part in a rearward lower region thereof being formed with openings.

Such a ventilating device or blower is known from Austrian Pat. No. 282,133. The outer casing thereof has a substantially square cross section and is accordingly destined to be built into the wall of a building. If one were to use this known ventilating device for installation in a window frame, it would have an optically disturbing and intrusive effect, in that it would project relatively far out of the window and into the room. This disadvantage becomes especially apparent if the outer casing is formed of synthetic material which requires walls of greater thickness.

The heretofore known ventilating device of the aforementioned Austrian Patent during the exhaust air operating phase thereof, blows the exhaust air out in vertically downward direction through rear openings formed in the casing part and, during the inlet air operating phase thereof, sucks the inlet air in vertically from below. Although this known construction ensures that no rain water can penetrate into the openings, it nevertheless has the disadvantage that the walls of the building are dirtied due to the air flowing in and out of the ventilating device.

Another disadvantage of the outer casing of the device of the aforementioned Austrian patent is that the lid thereof is flat and thereby has only a limited stability.

The foregoing disadvantages of the heretofore known device of the aforementioned Austrian patent result from the construction of the outer casing. It is accordingly an object of the invention of the instant application to provide a ventilating device with an outer casing which avoids the foregoing disadvantages of the aforementioned heretofore known device.

With the foregoing and other objects in view, there is provided in accordance with the invention, ventilating device comprising an outer casing formed of a casing part having a forward side formed with an opening and a lid articulatingly connected to a lower forward edge of the casing part partly defining the opening, the outer casing being installable in a window frame, the outer casing being elongated and having a substantially uniform cross section over the entire length thereof, the casing part in a rearward lower region thereof being formed with openings, the outer casing in closed condition of the lid and the casing part having an octagonal outer cross section with upper and lower horizontal surfaces engageable by correspondingly wide surfaces of a window frame, with a forward vertical surface entirely and both forward inclined surfaces at least partly formed by the lid, and with a lower rearward inclined surface wherein the openings are formed.

Due to the octagonal cross-sectional shape, only parts of the outer casing that are trapezoidal in cross-section project into the inner space and into the outer space. Due to the inclined surfaces, the trapezoidal parts are far less conspicuous than the corresponding square-shaped parts of the ventilating device of the aforementioned Austrian patent. The openings formed at various locations in the lower outwardly inclined surfaces, after the outer casing has been formed, for example, by a continuous extrusion process, constitute air discharge openings during the exhaust air operating phase of the ventilating device, so that the air blown out of these openings does not flow vertically downwardly at the window or building wall because of the orientation of the openings, but rather flows off at an inclination to the wall or window and can therefore not dirty the wall or window. During the inlet air operating phase of the ventilating device of the invention, the flow relationships are exactly reversed which also excludes any possibility of dirtying the wall or the window. The lid is of channel-shaped construction and is thereby very stiff or rigid.

To manufacture the outer casing of the ventilating device of the invention, both of the extruded parts, namely the casing part and the lid are initially cut to desired length. The openings are then formed in the lower rearward inclined surface, for example, by punching or stamping.

For reasons relating to manufacturing technology, it is desirable to be able to effect the assembly of the ventilating device if possible without the use of any tools. In accordance, therefore, with another feature of the invention, the ventilating device of the invention is provided with a blower motor and a pair of blower wheels, respectively, at opposite axial ends of the blower motor mounted in the outer casing and enclosed therein in an air guide casing extending in longitudinal direction of the outer casing, the air guide casing having in an upper region thereof a relatively short holding strip and being inwardly resilient in that region so that the holding strip is capable of being snapped into engagement in a groove formed in the inner wall surface of the casing part, the casing part having a forwardly inclined inner wall surface extending from the snap-in groove in direction toward the lid opening.

In accordance with an additional feature of the invention, the air guide casing carries at least two spouts engaging in the openings formed in the lower rearward inclined surface of the outer casing.

The air guide casing, with the blower motor and two blower wheels assembled therein, is slid, with the spouts in advance, through the opened lid opening into the outer housing. Upon subsequent sliding of the spouts into the openings formed in the lower outer inclined surface, which correspond to the spouts, a turning movement is introduced during which the relatively short holding strip slides inwardly toward the forward inclined surface and accordingly resiliently force radially inwardly until it resiliently snaps into the snap-in groove. The structural unit formed of an air guide casing with a blower motor and two blower wheels mounted therein is, thus, reliably assembled in the outer housing without any likelihood of being lost therefrom.

In accordance with an added feature of the invention, the air guide casing is interrupted in a rear region thereof extending from the relatively short holding strip to the spouts and is substituted in the rear region thereof by a correspondingly curved guide section of the inner wall of the casing part. This results not only in a saving of material, because in this rearward region the inner wall of the casing part is used for air guidance, but also has the advantage that it permits the installation of the blower motor and both blower wheels in radial direction into the air guide casing, in contrast to which it was heretofore necessary to install them in axial direction.

In accordance with yet another feature of the invention, the ventilating or blower motor has plug-in contacts, and the guide section of the casing part is formed with two current conductor grooves extending in longitudinal direction of the outer casing, the plug-in contacts of the ventilating motor engaging in the current conductor grooves. This form of electric coupling according to the invention permits the air guide casing to be interrupted in the aforedescribed manner in the rearward region thereof.

Advantageously, both current conductor grooves are located in a vertically extending region of the guide section. Simultaneously, when installing the air guide casing into the outer casing, with the spouts disposed in front, the plug-in contacts of the blower motor engage in the current conductor grooves which extend along the entire length of the outer casing.

In accordance with a further feature of the invention, the casing part, in an upper region of the inner wall surface thereof, which is located beyond i.e. forward of, the guide section thereof, is formed with a rearwardly grippable groove that is located opposite another rearwardly grippable groove formed in a lower region of the inner wall surface of the casing part. Both of these rearwardly grippable grooves, which also extend over the entire length of the casing part, can serve various purposes. In accordance with an added feature of the invention, a stiffening rod is provided which is formed with dovetail-shaped projections that are respectively receivable in the rearwardly grippable grooves. Also, a mounting or assembly plate is provided which is also formed with dovetail-shaped projections that are respectively receivable in the rearwardly grippable grooves. Advantageously, moreover, the rearwardly grippable grooves are of T-shaped construction.

In accordance with another feature of the invention, during the exhaust air operating phase of the ventilating device, the openings formed in the lower rearward inclined surface of the casing part extend along the length of the spouts which open outwardly, the spouts being air-tightly fitted in the openings.

In accordance with concomitant features of the invention, during the inlet air operating phase of the ventilating device, the openings formed in the rearward inclined surface of the casing part extend along the length of the spouts which are closed to the outside, the spouts being received in the openings, the lower rearward inclined surface being formed with additional openings air-conductively communicating with axial air suction openings formed in the air guide casing, and including relatively narrow air guide diaphragms resiliently received, on the one hand, in holding grooves formed in the air guide casing above and below an air outlet opening also formed in the air guide casing and, on the other hand, in corresponding holding grooves formed in the casing part, and extending over the entire length of the outer casing. Moreover, when at least two axially spaced-apart air guide casings are located in the outer casing, relatively large air guide diaphragms may be provided resiliently received in both the holding grooves formed in the casing part and extending between the axially spaced-apart air guide casings. The spouts are closed during the inlet air operating phase of the ventilating device of the invention, so that the air blown out by the blower wheels in radial direction cannot discharge through the spouts but must rather escape through the air outlet openings of the air guide casing located at the lid-side and then pass out through the lid opening. On the other hand, care must be taken to prevent the air sucked in by the blower wheels in axial direction from being sucked in from the inner room in the window of which the ventilating device of the invention is mounted; the narrow and wide air guide diaphragms serve in this regard by assuring that the air sucked in axially by the blower wheels is not sucked in from the inner room but rather through the openings in the lower rearward inclined surface of the outer casing.

German Published Prosecuted Application DT-AS 1 286 727 discloses a ventilating device with a lid articulatingly connected to the lower forward edge of a casing part, and an actuating device for opening and closing the lid, the actuating device including an eccentrically mounted pin revolvable about a rotational axis or shaft, the pin being connected by a helical spring with the free end or edge of the lid.

In accordance with the construction of the device of the foregoing German published and prosecuted application, the actuating disc is driven by an adjusting motor. However, such a form of drive is relatively expensive. Accordingly, the invention of the instant application is an improvement over the device of the foregoing German published and prosecuted application, in that a manually actuatable device is provided which does not permit turning of the actuating disc from one limit position to the other through actuation of the lid.

Thus, in accordance with the invention of the instant application, the ventilating device includes actuating means for opening and closing the lid, and comprises an eccentrically mounted pin revolvable about a rotary or rotational shaft or axis, helical spring means connecting the pin with the free edge of the lid, a mounting or assembly plate carrying the rotary shaft as well as a stop pin, a wheel rotatably mounted on the rotary shaft and having two stop spokes cooperating with the stop pin so as to limit turning movement of the wheel to substantially 270°, the helical spring means and the linear extension thereof, respectively, in both limiting positions of the wheel, extending between an imaginary extension of the rotary shaft and the stop pin, the pin connecting the spring means with the free edge of the lid being carried by the wheel near the periphery thereof.

The just-mentioned construction affords manual actuation of the device. To revolve the eccentric stop pin from the limit position thereof, the spring means must be raised over the rotary shaft; this cannot be caused by unintentional vibration or jolts so that due to this snap-in effect, the lid is securely closed. During the further turning movement in direction to the open position of the lid, the spring means is tension-relieved or expanded so that the lid collapses or snaps back into the open position thereof. In the completely opened position of the lid, the extension of the spring lies underneath the rotary shaft, so that no turning of the wheel is introduced by outside pressure on the lid and thereby no closing of the lid can occur. Also, in the open position, a desired locking or bolting of the lid is achieved.

In accordance with yet another feature of the invention, the wheel is formed at the outer periphery thereof with an encircling, radially open cable line groove, and a cable line is disposed in the peripheral groove and secured at a location therein, both free end portions of the cable line being diverted from the plane of the wheel in longitudinal direction of the outer casing and extending to one end of the outer casing. This control of the wheel at the outer periphery thereof has the advantage that the applied controlling forces act with a lever arm that is as long as possible and can consequently overcome a strong spring force relatively easily; in view of this construction, without having to fear the occurrence of any control difficulties, a helical spring with a very strong spring force can be used so as to achieve an exceptional lid closing action.

To prevent the cable line from springing out of the peripheral groove, in accordance with a further feature of the invention, the mounting or assembly plate is formed with a cover collar covering the cable-line groove at least where the cable-line is received therein.

In order that the lid should open when the wheel is turned to a position wherein the eccentric pin is located in front, the helical spring means is advantageously given a stiff or rigid construction so that it is capable of transmitting thrusts or jolts applied to the lid.

In accordance with an added feature of the invention, and in order to minimize assembly thereof, the air guide casing extends in longitudinal direction of the outer casing carrying at both ends thereof a radial wall integral with the air guide casing and formed with respective air suction openings, and in addition, two support walls are installed in the air guide casing.

In accordance with another feature of the invention, each of the support walls is formed with an axial air suction opening through which sucked-in air flows coolingly over the blower motor.

An especially simplified construction that is readily produced of synthetic material in an extrusion process for releasably connecting each support wall to the air guide casing, in accordance with the invention, is effected by providing an air guide casing that is formed on both sides of each support wall with respective beads closely engaging the support wall, the air guide casing being formed with at least one slot between each pair of beads, the respective support wall being formed with a hook engaging in the slot and facing away from the spout, a relatively short section of the air guide casing being located between the hook and the surface of the support wall.

To assemble a support wall in the air guide casing, the support wall is placed between both beads and the hook is stuck through the slot. A small turning movement brings the hook into a position wherein it rearwardly grips the air guide casing along a short section thereof. Because both the support wall as well as the air guide casing respectively, have a short region thereof forming and limiting the spouts laterally and at the bottom thereof, assurance is provided that the support wall cannot turn, relative to air guide casing as soon as the support wall with the air guide casing is inserted in the openings provided for the spouts. The inventive construction with the rearwardly gripping hook thus affords a relatively simple assembly procedure without requiring the use of any tool so that, in spite of the relative simplicity of the construction, no loosening of the connection is possible. In this regard, the beads promote the preclusion of any lateral displacement or shifting of the support wall, in axial direction. The lateral beads, which are advantageously somewhat chamfered or beveled toward the support wall can, of course, also be replaced by a series of cams.

In a heretofore known ventilating device according to German Pat. No. 1 960 197, a blower motor is mounted in an outer casing and has a drive shaft extending in longitudinal direction of the outer casing on both sides of the blower motor, and a blower wheel is mounted on the drive shaft at each side of the blower motor, the blower motor having a motor block supported at each end thereof in a support wall. This construction has the disadvantage that the relatively thin, semicircularly pivoted arms break rather easily during transportation. A more stable construction is provided in accordance with the invention by introducing diametrically opposing elastic bumpers or cushions, such as rubber bumpers, for example, on the one hand being seated in chambers carried by the support walls and, on the other hand, engaging in corresponding notches formed in a bearing plate for the motor block. Such a bearing or mounting system is insensitive to the jolts occurring during transportation and is relatively inexpensive to produce.

Such a system can be assembled without employing tools when, in accordance with another feature of the invention, the notches, on the one hand, and the chambers, on the other hand, are respectively formed with a radial stop or abutment surface as well as an axial stop or abutment surface, pairs of mutually opposing stop surfaces overlapping one another, the notches, on the one hand, and the chambers, on the other hand, being respectively formed with two lateral stop surfaces that are connected one to the other. With such a construction, the bumpers can be seated between the mutually overlapping stop surfaces; in the assembled condition, no danger exists, because of the mutual overlapping of these stop surfaces, that the rubber bumpers will move out of the position thereof when vibration occurs.

The suspension system of the motor in accordance with the invention is assembled as follows:

In all of the four chambers of a pair of support walls, four bumpers or cushions are disposed. The motor block is located between two pairs of bumpers, respectively, the bumpers engaging in corresponding notches formed in the bearing plate of the motor block. The ventilating or blower wheels or impellers are mounted on shafts projecting from the motor block. The structural unit formed of the motor block, both support walls and both blower wheels are then installed into the air guide casing while employing the aforedescribed hook-slot coupling. Finally, the entire structural unit i.e. the air guide casing with the motor and the blower wheels, is slid into the outer housing in the aforedescribed manner, both hooks of both support walls engaging in the corresponding slots formed in the air guide casing. It is believed to be readily apparent that an assembly without the use of any tools is possible in this manner. pin, said pin connecting said spring means with the free edge of said lid being carried by said wheel near the periphery thereof.

Other features which are considered as characteristic for the invention are set forth in the appended claims.

Although the invention is illustrated and described herein as ventilating device, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which:

FIG. 1 is a cross-sectional view, taken along the line I—I in FIG. 9, of a ventilating device during the exhaust air operating phase thereof, according to the invention;

FIGS. 2 through 7 show various components of the ventilating device of FIG. 1, FIGS. 2 and 5 being elevational views and FIGS. 3, 4, 6 and 7 being sectional views;

FIG. 8 is a partly broken away elevational view of the ventilating device as seen from the right hand side of FIG. 1;

FIG. 9 is a longitudinal view, partly in section, of the ventilating device of FIG. 1 during the fresh or inlet air operating phase thereof;

Figure 16:
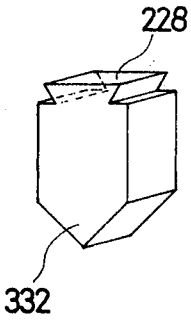
Figure 17:
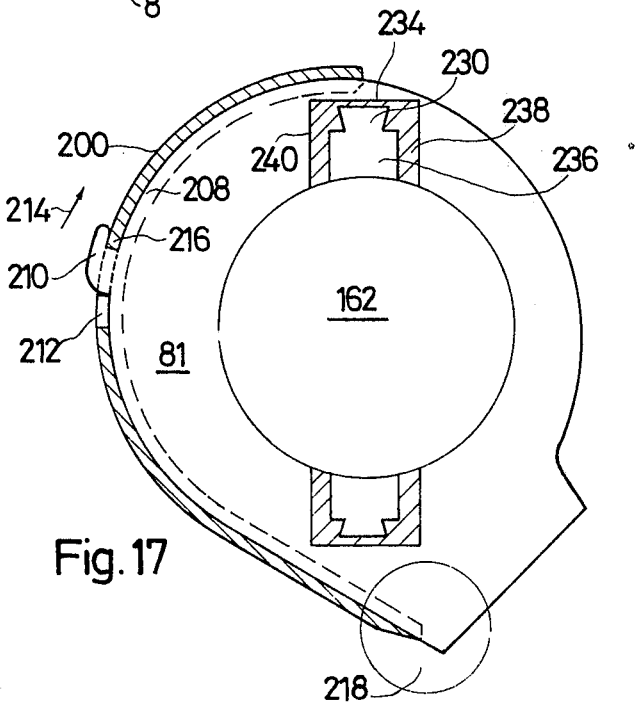
Figure 15:
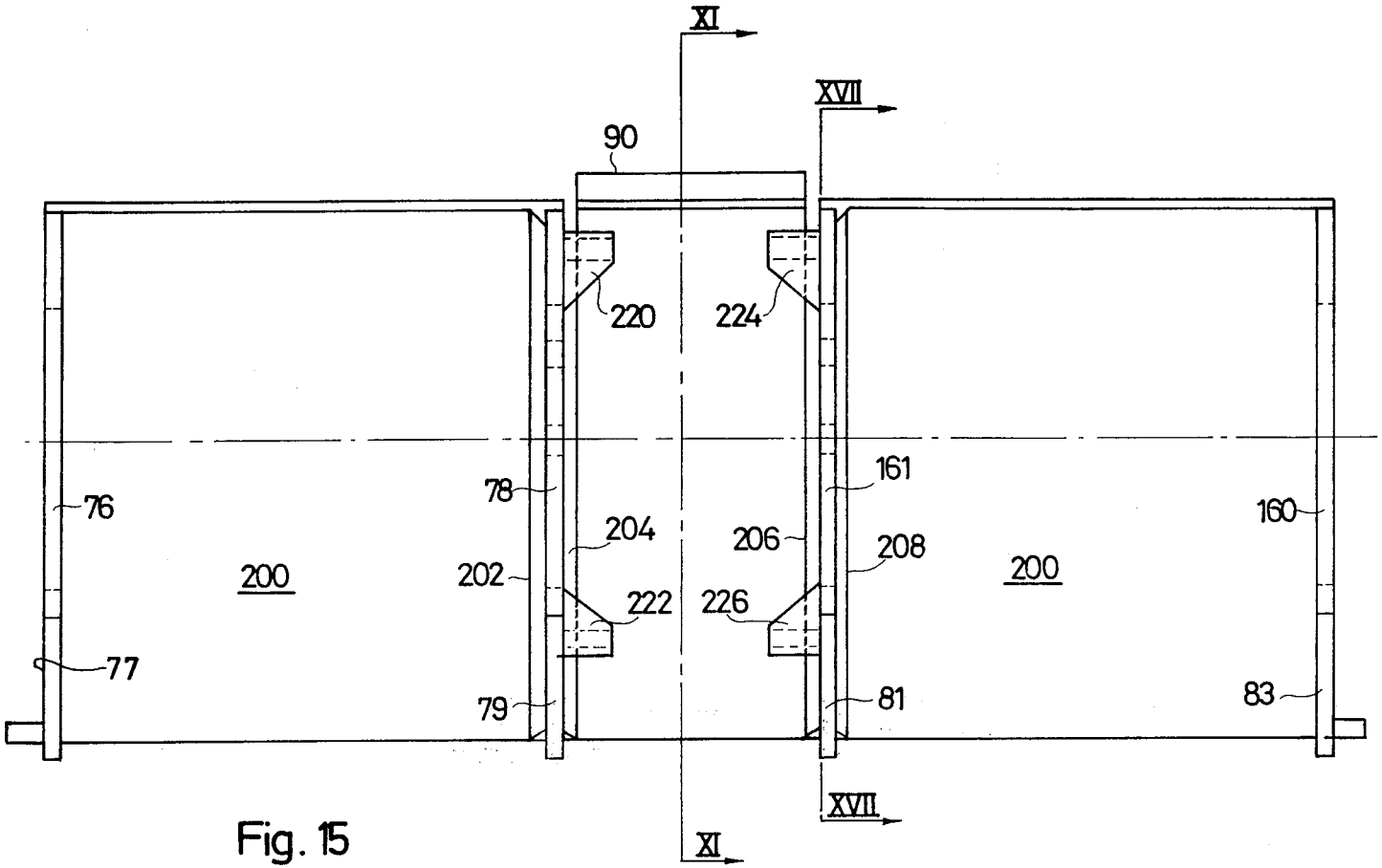

FIG. 15 ia a longitudinal view of the air guide casing of the ventilating device during the exhaust air operating phase thereof; with support walls inserted therein and viewed in direction opposite that of the arrows 21;

FIG. 16 is an enlarged perspective view of a cushion or bumper used with the ventilating device of the invention; and FIG. 17 is a cross-sectional view of FIG. 15 taken along the line XVII—XVII.

Referring now to the drawing and first, particularly to FIG. 1 thereof, there is shown, in cross-sectional view along the line I—I of hereinafter-described FIG. 9, a ventilating device constructed in accordance with the invention, having at the outer periphery thereof an octagonal casing formed of two components, namely a casing part 2 and a lid 4 therefor. The casing part 2 has an upper horizontal surface 6, as viewed in FIG. 1, a rear vertical surface 12, shown at the right-hand side of FIG. 1, and a lower horizontal surface 8. The lid 4 has a surface 10 which, when the lid 4 is closed as shown in phantom, forms the front vertical surface of the outer casing. The four vertical and horizontal surfaces 6, 12, 8 and 10, as the case may be, are connected one to another by four inclined surfaces. The casing part 2 connects the upper horizontal surface 6 thereof with the rear vertical surface 12. The lower rear inclined surface 16, which connects the lower horizontal surface 8 of the casing part 2 with the rear vertical surface 12 thereof is inwardly offset to form an antechamber 18.

Figure 1:
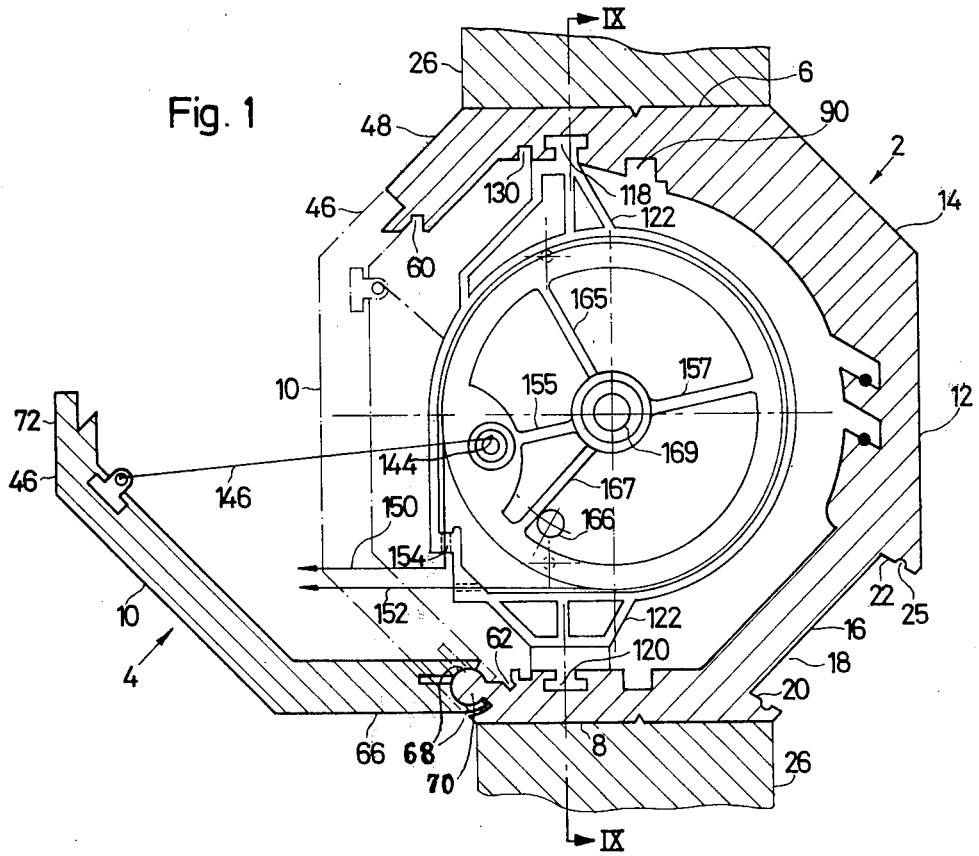
Figure 2:
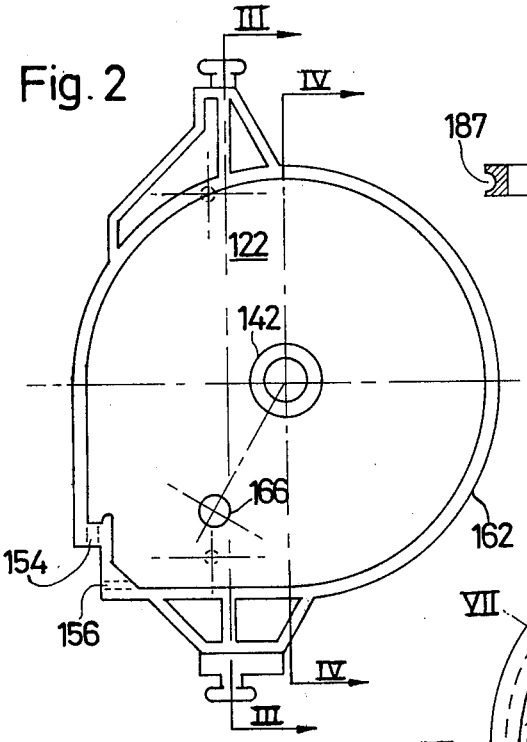

The width of the upper and lower horizontal surfaces 6 and 8 of the casing part 2 is equal to that of a schematically illustrated window frame 26, so that the outer casing, forwardly i.e. to the left-hand side of FIG. 1, as well as rearwardly i.e. to the right-hand side of FIG. 1, are formed with respective projections having trapezoidal sections, which, because of the inclined surfaces, appear optically less disturbing to the viewer's eye than if rectangular boxes were located at both sides of the casing.

The free edge of the lower forward inclined surface 66 formed by the lid 4 is constructed as a pair of claws 68 which surround the cylindrically formed lower forward edge 70 of the lower horizontal surface 8 of the casing part 2 and thereby forms an articulating joint or hinge about which the lid 4 is pivotable. The lid 4 is shown in open position in the solid-line representation thereof in FIG. 1, and in closed position in the phantom or dot-dash representation thereof.

The lid 4 is channel-shaped. The various surfaces 66, 10 and 46 thereof define an angle of 45° one with the other. The lid 4 is therefore very stiff or rigid and resists torsion and bending. The viewer sees only the forward vertical surface 10 and the lower forward inclined surface 66 in the closed position of the lid 4 i.e. as represented in phantom in FIG. 1; the upper forward inclined surface 46 and 48 is not visible because of the inclination thereof so that the outer casing appears to be much lower than it really is.

FIG. 8 is an elevational view of the ventilating device of the invention, as seen from the right-hand side of FIG. 1. The upper rear inclined surface 14 appears foreshortened perspectively, whereas the rear vertical surface 12 is represented with the full height thereof. The lower rear inclined surface 16, at the lefthand side thereof as shown in FIG. 8 is covered by a screen 28 which is shown broken away along the line 29 in order to permit viewing of break-throughs or perforations 30 and 32 formed in the surface 16. Spouts 96, through which air is blown out during the exhaust air operating phase of the ventilating device, are located in the perforations 30 and 32. Sections of support and radial walls 77, 79, 81 and 83 of an air guide casing 200 hereinafter described with respect to FIGS. 9 and 10, laterally border on the spouts 96.

FIG. 8 also shows strips 42 and 44 which are employed for servicing the actuating device for the lid 4 which is described hereinafter in greater and more exact detail with respect to FIG. 1.

FIG. 9 (during the inlet air operating phase thereof) provides a sectional view at the left-hand side thereof (taken along the section line IX—IX in FIG. 1) and a front elevational view of the ventilating device shown in FIG. 1 i.e. as viewed in direction out from the interior space thereof. In this connection, the lid 4 is open as in FIG. 1; in both FIGS. 1 and 9, the upper forward inclined surface 46 of the lid 4, the forward vertical surface 10 of the lid 4 as well as the upper forward inclined surface 48 of the casing part 2 are clearly seen. A blower or fan wheel 50 is half covered by the lid 4. In the left-hand side of FIG. 9, the lid 4 is shown broken away along the line 52, so that a second blower or fan wheel 54 is quite visible. A motor block 56 is located between both blower or fan wheels 50 and 54.

In the right-hand side of FIG. 9, the actuating device 64 for the lid 4 controllable by means of the strips 42 and 44 is diagrammatically illustrated. This should actually be located in the middle of the ventilating device, however, for reasons of clarity, it is shown as being located at one end of the ventilating device.

The section line I—I represents the plane of the sectional view presented in FIG. 1 to show the actuating device 64.

As shown in FIG. 9, respective blowers or fan wheels 50 and 54 are connected at the right-hand and left-hand sides of the figure to the motor block 56 of a blower or fan motor.

Figure 11:
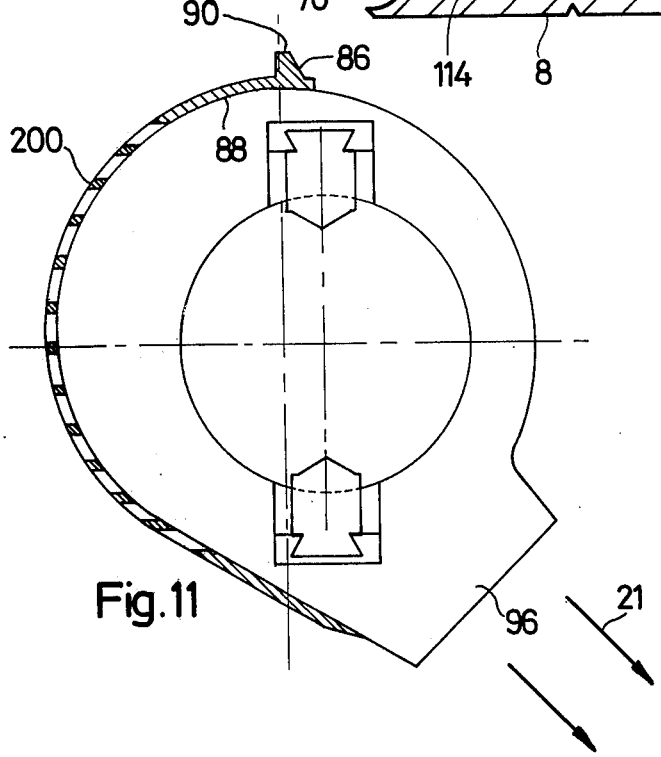
FIG. 11 is a cross-sectional view of FIG. 15 taken along the line XI—XI therein, with the motor block omitted, during the exhaust air operating phase of the ventilating device.

The air guide casing 200 (FIG. 11) collectively surrounds the motor block 56 as well as both of the blower or fan wheels 50 and 54 associated therewith. According to FIG. 9, the air guide casing 200 has two radial walls 77 and 83 as well as two support walls 79 and 81. The motor block 56 is disposed between the inner support walls 79 and 81. The blower or fan wheel 54 is mounted between the walls 77 and 79, and the blower or fan wheel 50 between the walls 81 and 83. Each of the walls has an axial air suction 76, 78 formed therein. The blower or fan wheels 50 and 54 suck air through the openings 76 and 78 in axial direction and blow it out in radial direction.

Figure 10:
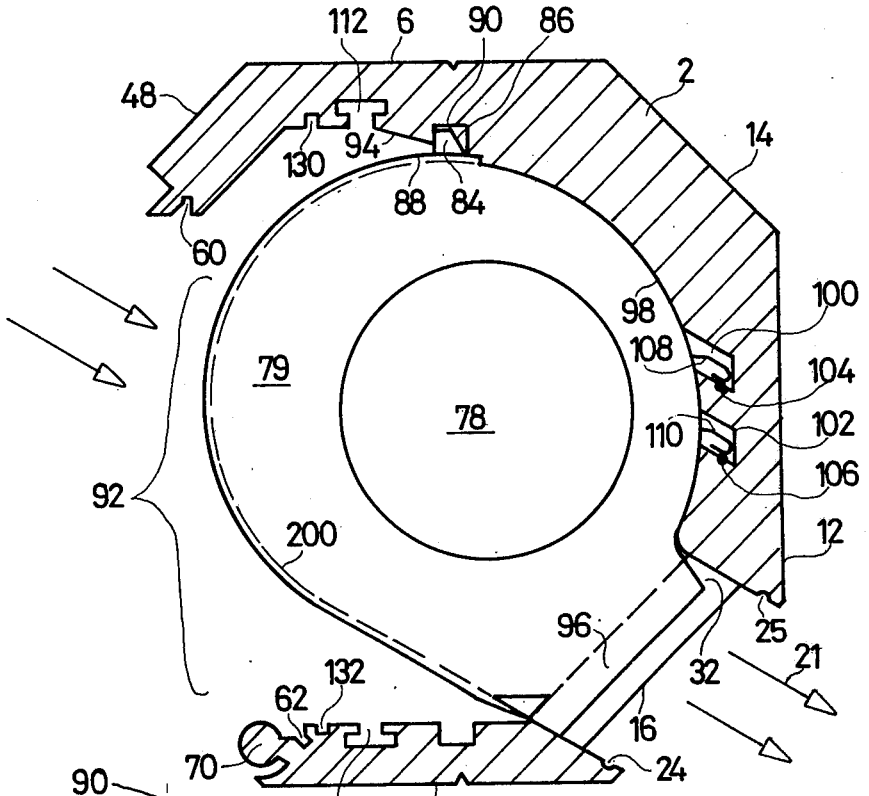
FIG. 10 is a cross-sectional view of FIG. 9 taken along the line X—X, with the blower or fan wheel omitted, and during the exhaust air operating phase of the ventilating device.

The cross section of the air guide casing 200 (in exhaust air operating phase of the ventilating device) is shown more clearly in FIG. 10, which presents a sectional view taken along the line X—X in FIG. 9. The air guide casing 200 carries, in the upper region 88 thereof, a short holding strip or rail 84 which is formed at the rear thereof i.e. at the right-hand side thereof, as viewed in FIG. 10, with a rear inclined surface 86. The air guide casing 200 is of springy or resilient construction in the region 88 thereof. The holding strip 84 is associated with and engageable in a groove 90 formed in the inner wall surface of the housing part 2. A forward inclined surface 94 extends from the lid opening 92 to the groove 90. With the installation of the air guide casing 200 into which the motor block 56 and both blower or fan wheels 50 and 54 are built, the rear inclined surface 86 of the short holding strip 84 slides on and along the forward inclined surface 94 of the housing part 2, the region 88 of the air guide casing 200 being springily or resiliently forced inwardly until the short holding strip 84 clicks or engages resiliently into the groove 90.

In FIG. 10, there is furthermore shown the spout 96 that is associated with the blower or fan wheel 54 and engages airtightly in the break-through or perforation 32 (note FIG. 8) formed in the lower rear inclined surface 16 when being slid into the housing part 2 at the instant in which the short holding strip 84 snaps into the engaging groove 90 in a rearwardly gripping manner.

It is also apparent from FIG. 10 that the air guide casing 200, in the rear region thereof, is interrupted from the holding strip 84 to the spout 96 and is replaced thereat by a suitably curved guide section 98 of the inner wall surface of the housing part 2. Thus, as viewed in FIG. 10, the guide section 98 makes up about one fourth of the periphery of the entire air guide casing 200. In the vertically extending region of the guide section 98, two current conductor grooves 100 and 102 are formed and extend in longitudinal direction of the outer casing i.e. perpendicularly to the plane of the drawing of FIG. 10. Respective current conductors 104 and 106 are received in the grooves 100 and 102 and extend along the entire length of the ventilating device. When the air guide casing 200 is installed into the housing part 2, plug contacts 108 and 110 of the ventilating motor engage in current conductor grooves 100 and 102, respectively, and come into contact with the respective conductors 104 and 106 received therein, whereby the electrical connection between the motor and main current supply is produced without requiring the use of any tools.

According to FIG. 10, the housing part 2 in the upper inner wall surface thereof, outside of the guide section 98 and in front of the forward inclined surface 94 is formed with a rearwardly grippable T-shaped groove 122 which is located above and opposite another rearwardly grippable T-shaped groove 114 formed in the lower inner wall surface of the housing part 2.

Figure 13:
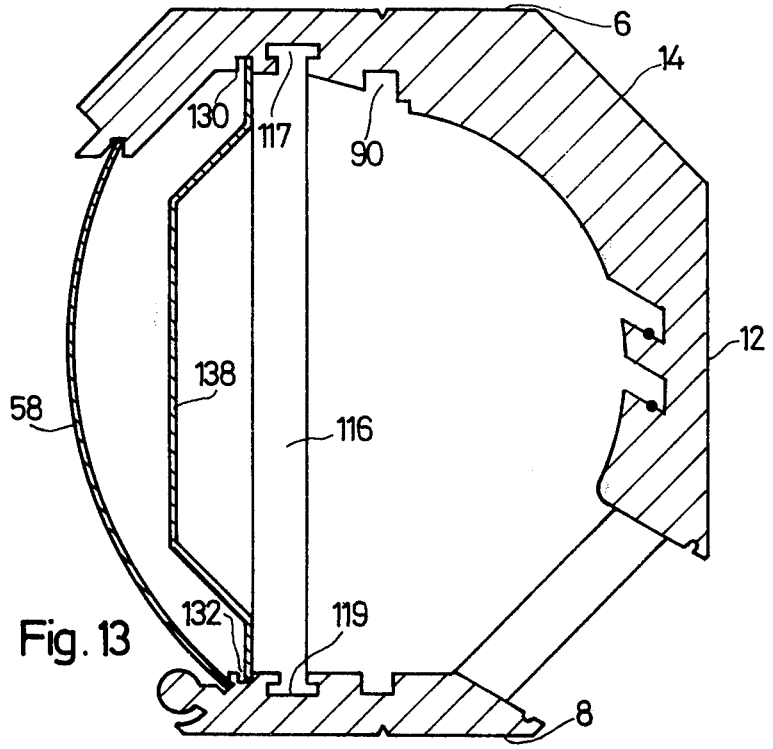
FIG. 13 is a cross-sectional view of FIG. 9 taken along the line XIII—XIII, during the inlet air operating phase of the ventilating device.

In accordance with FIG. 13, which is a cross-sectional view of FIG. 9 along the line XIII—XIII, stiffening or reinforcing rods 116 are insertable into the rearwardly grippable grooves 112 and 114, respectively. Such stiffening rods 116, when the ventilating devices are very long, are disposed in the free space between two adjacent air guide casings which, respectively, enclose a motor block and two blower or fan wheels, in order to reinforce or stiffen the horizontal surfaces of the casing 2 relative to one another. The rearwardly grippable grooves 112 and 114 can also serve to receive therein substantially dovetail-shaped projections 118 and 120 of an assembly plate 122 shown diagrammatically in FIG. 1, which carries the actuating device 64 (FIGS. 1 and 9) for the lid 4. The assembly plate 122 also simultaneously fulfills a stiffening or reinforcing function.

Figure 12:
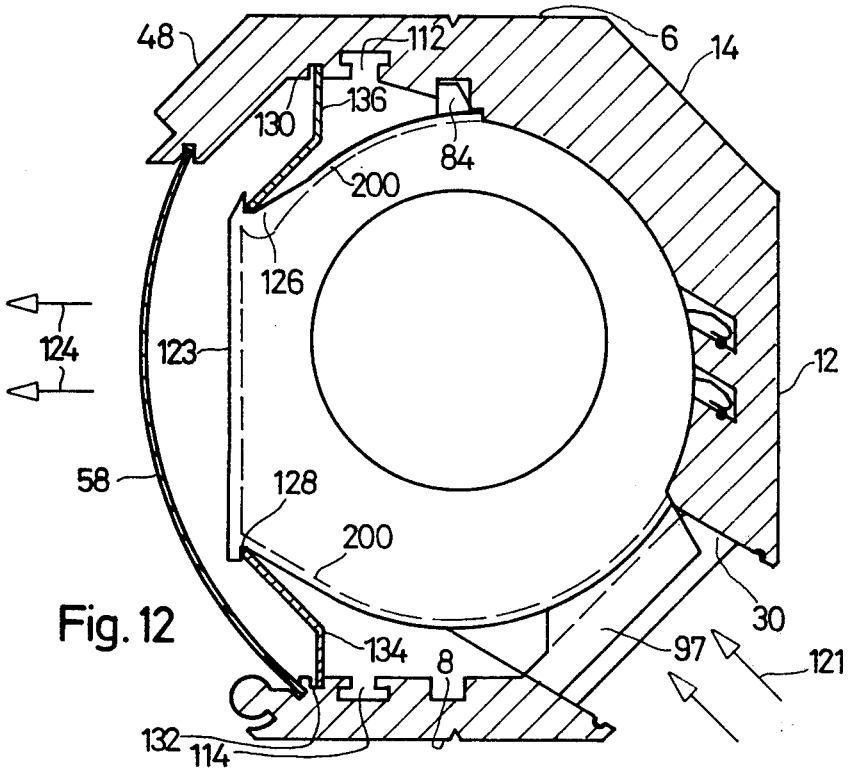
FIG. 12 is a cross-sectional view of FIG. 9 taken along the line X—X, with the blower or fan wheel omitted, during the fresh or inlet air operating phase of the ventilating device.
Figure 14:
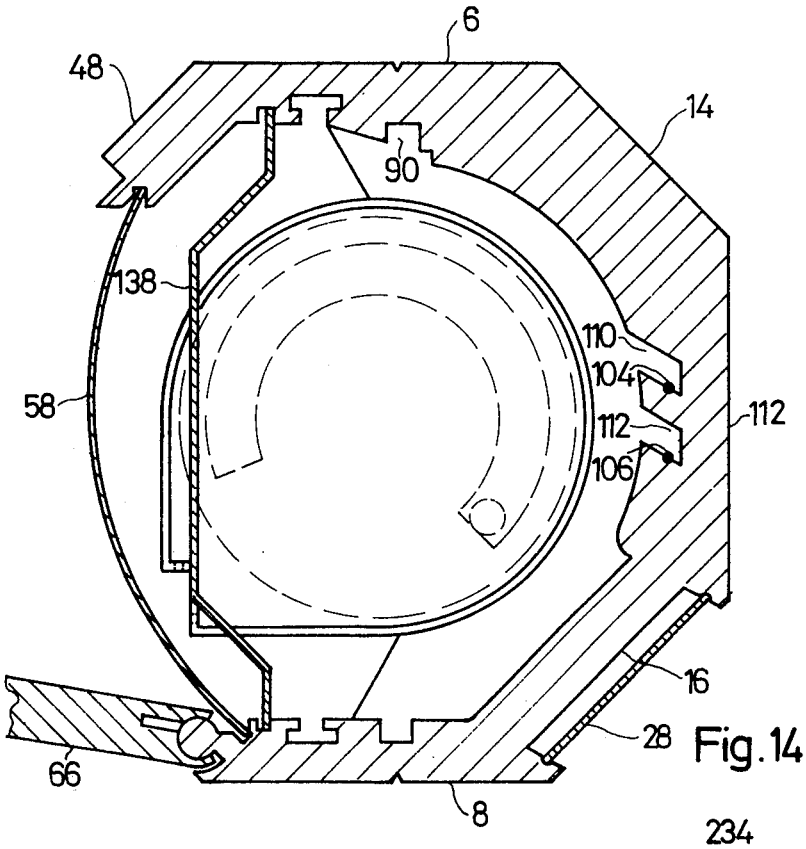
FIG. 14 is a cross-sectional view, taken along the line I—I, like FIG. 1, except that the blower fan is omitted and the ventilating device is in the inlet air operating phase thereof.

The ventilating device of the invention can be constructed so as to be selectively serviceable for exhaust air operation (FIGS. 8 and 10) or for inlet air operation (FIGS. 12, 13 and 14).

FIG. 12 is a cross-sectional view along the line X—X in FIG. 9, thus at the same location as shown in FIG. 10, with the difference that FIG. 10 depicts the ventilating device in the exhaust air operating phase thereof, while FIG. 12 shows the ventilating device in the inlet air operating phase thereof.

During exhaust air operation (FIGS. 8 and 10), an open connection or communication exists between the lid opening 92 and the axial suction openings 76, 78 of the walls 77, 79, 81 and 83, so that the blower or fan wheels 50 and 54 suck out the air from the inner space when the lid 4 is open. The spouts 96 each of which is associated, respectively, with one of the blower or fan wheels 50 or 54, openly communicate with or terminate at the break-through or openings 30 and 32, so that the air radially ejected by the blower or fan wheels is blown out through the spouts 96 and the break-throughs or openings 30 and 32 into the outside.

During inlet air operation, the spouts 97 (FIG. 12) are closed with respect to the openings or perforations 30 and 32 and thus exclusively fulfill their guidance function. Further openings air-conductively connected to the axial air suction openings of the air guide casing are provided in the lower rearwardly inclined surface 16, so that fresh inlet air is sucked in along the direction of the arrows 121 as shown in FIG. 12. The air guide casing is provided with an air outlet opening 123 facing the lid opening 92, air sucked-in in direction of the arrows 121 being blown out in direction of the arrows 124 into the inner space (toward the lefthand side of FIG. 12). In this regard, assurance must be provided that air will not be sucked in simultaneously from the inner space i.e. from the left-hand side as viewed in FIG. 12, as is the case during exhaust air operation, as shown in FIG. 10. For this purpose, narrow air guide diaphragms or screens 134 and 136, extending along the entire length of the outer casing, are inserted into holding grooves 126 and 128 of the air guide casing 200 that are located above and below the air outlet opening 123 at the lid side, on the one hand, and in suitable holding grooves 130 and 132 formed in the casing part 2, on the other hand. An air outlet opening 123 is associated respectively, with each of the blower or fan blades 50 and 54.

In the region between the air outlet openings 123, the sucking-in of false air from the inner space i.e. the space located at the left-hand side of FIG. 12, is prevented by resiliently inserting wide air guide diaphragms 138 (FIG. 13) between both holding grooves 130 and 132 of the casing part 2, the air guide diaphragms 138 having vertically disposed sections thereof extending into the holder grooves 130 and 132 and engaging the stiffening rods 116 just as the narrow air guide diaphragms 134 and 136 do.

Figure 7:
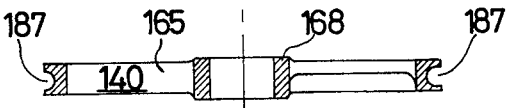
Figure 5:
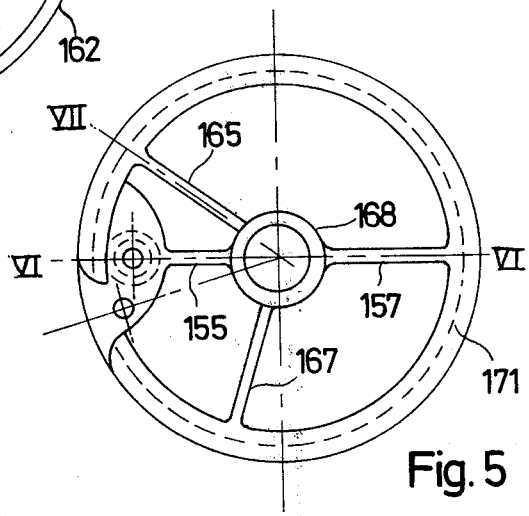
Figure 3:
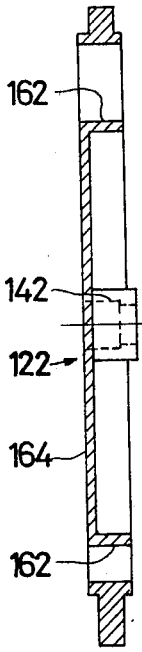
Figure 4:
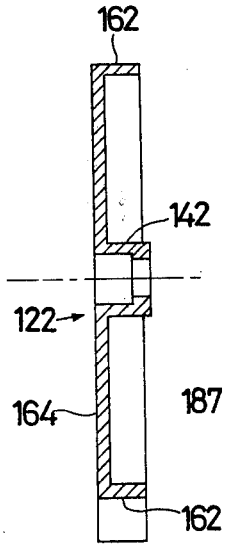
Figure 6:
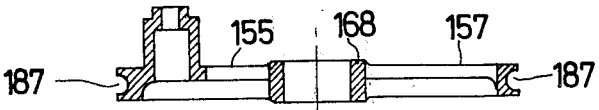

FIGS. 1 to 7 show an actuating device for opening and closing the lid 4. The actuating device is formed substantially of the assembly plate 122 shown in FIGS. 2, 3 and 4 and the blower or fan wheel or impeller 140. FIGS. 3 and 4 are sectional views of FIG. 2 taken along the lines III—III and IV—IV, respectively. FIGS. 6 and 7 are sectional views of FIG. 5 taken along the lines VI—VI and VII—VII, respectively. The assembly or mounting plate 122 has a dish-shaped construction. In the middle thereof, the plate 122 carries a hollow rotary shaft 142, and at the outer edge of the plate 122 a cover collar 162. In addition, a stop or positioning pin 166 is located eccentrically to the rotary shaft 142, on the base 164 of the assembly or mounting plate 122.

As is apparent in FIG. 1, the wheel or impeller 140 shown in FIGS. 5, 6 and 7 is mounted by the hub 168 thereof on the rotary shaft 142 of the dish-shaped mounting or assembly plate 122. Both members, namely, the hub 168 and the rotary shaft 142 are connected one to the other by inserting a pin of synthetic material, for example, through both thereof, the pin having a head 169 (note FIG. 1) seated on the hub 168, the non-illustrated shank of the pin being in resilient gripping engagement behind the shaft 142 i.e. at the end thereof shown at the left-hand side of FIGS. 3 and 4. Also assembly is afforded thereat by means of a plug-in connection.

The wheel or impeller 140 is provided at the outer periphery thereof with a circular radially open tow or cable-line groove 187 (note FIGS. 6 and 7). A cable is disposed in the groove 187 and secured at 171 (FIG. 5). Both cables 150 and 152 of the tow or cable-line (FIG. 1) travel through two eyes 154 and 156 (FIG. 2) of the mounting or assembly plate 122. Both of the cables 150 and 152 of the tow or cable-line are deflected or re-oriented in the eyes 154 and 156, respectively, through an angle of substantially 90° out of the drawing plane of FIGS. 1 and 2, respectively, into the drawing plane of FIG. 9. Both of the cables 150 and 152, as shown in FIGS. 8 and 9, extend out of the side or end wall of the outer casing, having been diverted through an angle of substantially 90°, and merge into the strips 44 and 42, respectively, which are manually actuatable.

The wheel or impeller 140 has two stop spokes 167 and 165. Only these two spokes 167 and 165 engage the stop pin 166 when the wheel or impeller 140 is turned; both of the other illustrated spokes 155 and 157 (note also FIG. 6) do not come into contact with the pin 166 when the wheel or impeller 140 is turned, because both of the spokes 155 and 157 extend above the stop pin 166.

In accordance with FIG. 1, in the open position of the lid 4, when the spring 146 is unstressed, the stop spoke 167 is located at the stop pin 166. If the wheel or impeller 140 is turned clockwise, as viewed in FIG. 1, the lid 4 is then closed, the spring 146 which is secured in the pin 144 to the wheel or impeller 140 is stressed, and the stop spoke 165 engages the stop pin 166 from the other side i.e. from the right-hand side of FIG. 1. Both stop spokes 167 and 165 afford a turning movement of substantially 270° in this manner.

Since the extension line of the helical spring 146 passes between the rotary shaft 142, 168, 169 on the one hand, and the stop pin 166, on the other hand, a pressure exerted on the lid 4 in the open position thereof would effect a turn of the wheel or impeller 140 in counterclockwise direction, as viewed in FIG. 1, the stop pin 166, however, opposing this turn of the wheel 140; by applying pressure to the lid 4, the wheel 140 cannot therefore be turned into closed position thereof. In the position illustrated in FIG. 1, inadvertent closing of the lid 4 is precluded.

The closing operation can be effected deliberately (by means of the tow or cable-line) only by turning the wheel or impeller 140 in clockwise direction, as viewed in FIG. 1. The helical spring 146 is then at its greatest extension or stretch limit when it travels over the rotary shaft 142, 168, 169, in order then to contract, until the stop spoke 165 engages the stop pin 166 in the closing position. In this closing position, the helical spring 146 is stressed. The lid 4 may be opened only by deliberate actuation of the actuating disc in counterclockwise direction, as viewed in FIG. 1.

FIGS. 15 and 17 illustrate an advantageous construction of the support walls 79 and 81 so that these support walls can be assembled or mounted in the air guide casing 200 without requiring the use of tools. For this purpose, the air guide casing 200 is formed with four beads or rolls 202, 204, 206 and 208, each two beads, respectively, having a channel or groove therebetween into which a respective support wall 79 or 81 can be installed without play.

FIG. 17 is a sectional view of FIG. 15 taken along the line XVII—XVII wherein it can be seen that the support wall 81 is provided with a hook 210 which extends through a slot 212 formed in the air guide casing 200. The slot 212 is located at the base of the channel or groove defined by the beads 206 and 208. After the hook 210 has been stuck through the slot 212, the support wall 81 is then turned in direction of the arrow 214 so that the hook 210 partly extends over and engages a short section 216 of the air guide casing 200. In this condition, the support wall 81 fully engages the air guide casing 200 in the region 218 while forming the aforementioned spout 96. By inserting the thus-formed spout 96 into a suitable perforation or opening 30 to 32 (FIG. 8), the support wall 81 is prevented from turning in a direction opposite that of the arrow 214. In considering this construction, it is essential to the invention that the hook 210 faces away from the spout 96 or faces away from the region 218.

Each supporting wall 79 and 81 is formed with an axial air suction opening 78 and 161, respectively. The air is then sucked in by each ventilating wheel 54 and 50 (FIG. 8) axially through the respective two axial air suction openings 76 and 78, on the one hand, and 161 and 160, on the other hand, The inward suction through the inner axial air suction openings 78 and 161 of the support walls 79 and 81 has the additional advantage that the sucked-in air flows over the motor block 56 (FIG. 1) and cools the latter.

Through the plug-in construction according to the invention, not only is assembly simplified and the use of tools dispensed with, but also, it is no longer necessary with such construction to stick the ventilating wheels in axial direction through the axial air suction openings. It is therefore no longer necessary to make these air suction openings as large as has heretofore been required for sticking the ventilating wheels therethrough, but rather they can now be constructed advantageously slightly smaller than the outer diameter of the ventilating wheels 50 and 54 so that an air current between the radial overpressure or high-pressure region and the axial negative or low-pressure region of the ventilating wheel in the vicinity of the circular limit or boundary of the air suction opening is prevented.

According to FIG. 15, each support wall 79 and 81 carries on the side thereof adjacent the motor block 56, respective open chambers 220, 222 and 224, 226, respectively, having openings facing toward the motor block. FIG. 17 includes a sectional view of the chambers 224 and 226 of the support wall 81 in which rubber bumpers or cushions, as shown in FIG. 16, are inserted in such a manner that they engage with the dove-tailed portions thereof in the correspondingly shaped region 230 of the respective chambers 224 and 226. The projecting section or wedge 232 of the rubber bumper (FIG. 16) engages in a corresponding notch formed in the motor block 56.

The bumper of FIG. 16 is enclosed on all sides, on the one hand, by the walls of the respective chamber 220, 222, 224, 226 and, on the other hand, by the motor block. The chamber is provided with an axial stop or abutment surface 236 as well as a radial stop or abutment surface 234. The corresponding notch formed in the motor block has corresponding respective opposing stop or abutment surfaces which overlap one another in such a manner that the rubber bumper, even if it not adhesively secured in the chamber, cannot fall out due to the vibrations during operation.

The lateral border or limiting areas 238 and 240 of the chamber are beveled or chamfered, as shown in FIG. 15 so that the motor block may be inserted therebetween; these chamfered lateral limiting surfaces are continued in corresponding limiting surfaces of the notch formed in the motor block 56.

I claim:

1. Ventilating device comprising an outer casing formed of a casing part having a forward side formed with an opening, and a lid articulatingly connected to a lower forward edge of said casing part, partly defining said opening, said outer casing being installable in a window frame, said outer casing being elongated and having a substantially uniform cross section over the entire length thereof, said casing part, in a rearward lower region thereof being formed with openings, said outer casing in closed condition of said lid and said casing part having a multi-sided outer cross section with upper and lower horizontal surfaces engageable by correspondingly wide surfaces of a window frame, with a forward vertical surface entirely and a lower forward inclined surface at least partly formed by said lid and with a lower rearward inclined surface wherein said openings are formed, including a blower motor and a pair of blower wheels, respectively at opposite axial ends of said blower motor, mounted in said outer casing and enclosed therein in an air guide casing extending in longitudinal direction of said outer casing, said air guide casing having in an upper region thereof a relatively short holding strip and being inwardly resilient in said region so as to snap said holding strip into engagement in a groove formed in the inner wall surface of said casing part, said casing part having a forwardly inclined inner wall surface extending from said snap-in groove in direction toward the lid opening.

2. Ventilating device comprising an outer casing formed of a casing part having a forward side formed with an opening, and a lid articulatingly connected to a lower forward edge of said casing part, partly defining said opening, said outer casing being installable in a window frame, said outer casing being elongated and having a substantially uniform cross section over the entire length thereof, said casing part, in a rearward lower region thereof being formed with openings, said outer casing in closed condition of said lid and said casing part having an octagonal outer cross section wit upper and lower horizotal surfaces engageable by correspondingly wide surfaces of a window frame, with a forward vertical surface entirely and both forward inclined surfaces at least partly formed by said lid and with a lower rearward inclined surface wherein said openings are ormed, including a blower motor and a pair of blower wheels, respectively at opposite axial ends of said blower motor, mounted in said outer casing and enclosed therein in an air guide casing extending in longitudinal direction of said outer casing, said air guide casing having in an upper region thereof a relatively short holding strip and being inwardly resilient in said region so as to snap said holding strip into engagement in a groove formed in the inner wall surface of said casing part, said casing part having a forwardly inclined inner wall surface extending from said snap-in groove in direction toward the lid opening.

3. Ventilating device according to claim 2 wherein said air guide casing carries at least two spouts engaging in said openings formed in said lower rearward inclined surface of said outer casing.

4. Ventilating device according to claim 3 wherein said air guide casing is interrupted in a rear region thereof extending from said relatively short holding strip to said spouts and is substituted in said rear region thereof in a correspondingly curved guide section of the inner wall of said casing part.

5. Ventilating device according to claim 4 wherein said blower motor has plug-in contacts, and said guide section of said casing part is formed with two current conductor grooves extending in longitudinal direction of said outer casing, said plug-in contacts of said ventilating motor engaging in said current conductor grooves.

6. Ventilating device according to claim 4 wherein said casing part in an upper region of the inner wall surface thereof located beyond said guide section thereof is formed with a rearwardly grippable groove, said rearwardly grippable groove being located opposite another rearwardly grippable groove formed in a lower region of the inner wall surface of said casing part.

7. Ventilating device according to claim 6 including a stiffening rod formed with dovetail-shaped projections respectively receivable in said rearwardly grippable grooves.

8. Ventilating device according to claim 6 including a mounting plate formed with dovetail-shaped projections respectively receivable in said rearwardly grippable grooves.

9. Ventilating device according to claim 3 wherein, in exhaust air operating phase thereof, said openings formed in said lower rearward inclined surface of said casing part extend over the length of said spouts which open outwardly, said spouts being air-tightly fitted in said openings.

10. Ventilating device according to claim 3 wherein, in inlet air operating phase thereof, said openings formed in said rearward inclined surface of said casing part extend over the length of said spouts which are closed to the outside, said spouts being received in said openings, said lower rearward inclined surface being formed with additional openings air-conductively communicating with axial air suction openings formed in said air guide casing, and including relatively narrow air guide diaphragms resiliently received, on the one hand, in holding grooves formed in said air guide casing above and below an air outlet opening also formed in said air guide casing and, on the other hand, in corresponding holding grooves formed in said casing part, and extending over the entire length of said outer casing.

11. Ventilating device according to claim 10 wherein at least two axially spaced-apart air guide casings are provided in said outer casing, and including relatively large air guide diaphragms resiliently received in both said holding grooves formed in said casing part and extending between said axially spaced-apart air guide casings.

12. Ventilating device comprising an outer casing formed of a casing part having a forward side formed with an opening, and a lid articulatingly connected to a lower forward edge of said casing part, partly defining said opening, said outer casing being installable in a window frame, said outer casing being elongated and having a substantially uniform cross section over the entire length thereof, said casing part, in a rearward lower region thereof being formed with openings, said outer casing in closed condition of said lid and said casing part having an octagonal outer cross section with upper and lower horizontal surfaces engageable by correspondingly wide surfaces of a window frame, with a forward vertical surface entirely and both forward inclined surfaces at least partly formed by said lid and with a lower rearward inclined surface wherein said openings are formed, including actuating means for opening and closing said lid and comprising an eccentrically mounted pin revolvable about a rotary shaft, helical spring means connecting said pin with the free edge of said lid, a mounting plate carrying said rotary shaft as well as a stop pin, a wheel rotatably mounted on said rotary shaft and having two stop spokes cooperating with said stop pin so as to limit turning movement of said wheel to substantially 270°, said helical spring means and the linear extension thereof, respectively, in both limiting positions of said wheel, extending between an imaginary extension of said rotary shaft and said stop 13. Ventilating device according to claim 12 wherein said helical spring means is so stiff as to be able to transmit thrusts applied to said lid.

14. Ventilating device according to claim 12 wherein said wheel is formed at the outer periphery thereof with an encircling, radially open cable line groove, and including a cable line disposed in said peripheral groove and secured at a location therein, both free end portions of said cable line being diverted from the plane of said wheel in longitudinal direction of said outer casing and extending to one end of said outer casing.

15. Ventilating device according to claim 14 wherein said mounting plate is formed with a cover collar covering said cable line groove at least where said cable line is received therein.

16. Ventilating device according to claim 2 wherein said air guide casing extending in longitudinal direction of said outer casing carries at both ends thereof a radial wall integral with said air guide casing and formed with respective air suction openings, and including two support walls installed in said air guide casing.

17. Ventilating device according to claim 16 including an axial air suction opening formed in each of said support walls.

18. Ventilating device according to claim 16 wherein said air guide casing is formed on both sides of each suppport wall with respective beads closely engaging said support wall, said air guide casing being formed with at least one slot between each pair of beads, the respective support wall being formed with a hook engaging in said slot and facing away from said spout, a relatively short section of said air guide casing being located between said hook and the surface of said support wall.

19. Ventilating device according to claim 18 wherein said slot is located substantially in the middle of a curved portion of said air guide casing.

20. Ventilating device according to claim 16 including a blower motor mounted in said outer casing and having a drive shaft extending in longitudinal direction of said outer casing on both sides of said blower motor, a blower wheel mounted on said drive shaft at each side of said blower motor, said blower motor having a motor block supported at each end thereof in a support wall, and diametrically opposing elastic bumpers, on the one hand, being seated in chambers carried by said support walls and, on the other hand, engaging in corresponding notches formed in a bearing plate of said motor block.

21. Ventilating device according to claim 20 wherein said notches, on the one hand, and said chambers, on the other hand, are respectively formed with a radial stop surface as well as an axial stop surface, pairs of mutually opposing stop surfaces overlapping one another, said notches, on the one hand, and said chambers, on the other hand, being respectively formed with two lateral stop surfaces that are connected one to the other.

* * * * *